US009199781B2

(12) United States Patent
Bosman

(10) Patent No.: US 9,199,781 B2
(45) Date of Patent: Dec. 1, 2015

(54) HERMETIC MICROWAVABLE PACKAGE WITH AUTOMATICALLY OPENING STEAM VENT

(71) Applicant: SONOCO DEVELOPMENT, INC., Hartsville, SC (US)

(72) Inventor: Brent Bosman, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 218 days.

(21) Appl. No.: 13/828,487

(22) Filed: Mar. 14, 2013

(65) Prior Publication Data

US 2014/0263292 A1 Sep. 18, 2014

(51) Int. Cl.

| | |
|---|---|
| ***H05B 6/80*** | (2006.01) |
| ***B65D 81/34*** | (2006.01) |
| ***B65D 33/01*** | (2006.01) |
| ***B65D 5/00*** | (2006.01) |
| ***B31B 17/74*** | (2006.01) |

(Continued)

(52) U.S. Cl.

CPC ..... *B65D 81/3461* (2013.01); *B31B 1/00* (2013.01); *B31B 17/74* (2013.01); *B65D 77/225* (2013.01); *B31B 2219/9051* (2013.01); *B31B 2219/9058* (2013.01); *B65D 2205/025* (2013.01)

(58) Field of Classification Search

CPC ..... B65D 81/3461; B65D 77/225; B65D 2205/025; B31B 17/74; B31B 1/00; B31B 2219/9058; B31B 2219/9051

USPC ..... 219/725, 727, 729, 730, 731, 734; 428/131, 172; 426/107, 109, 234, 241, 426/243, 106, 118; 493/128; 53/467; 383/103, 42, 45, 63, 66, 100, 105

See application file for complete search history.

(56) References Cited

U.S. PATENT DOCUMENTS

| | | | |
|---|---|---|---|
| 3,432,087 | A | 3/1969 | Costello |
| 3,937,396 | A | 2/1976 | Schneider |
| 4,874,620 | A | 10/1989 | Mendenhall et al. |

(Continued)

FOREIGN PATENT DOCUMENTS

| | | | |
|---|---|---|---|
| DE | 1909232 | A1 | 9/1970 |
| EP | 1 122 189 | A1 | 8/2001 |

(Continued)

OTHER PUBLICATIONS

European Search Report for Application No. EP 14 15 8974 dated Jun. 27, 2014.

(Continued)

*Primary Examiner* — Quang Van

(74) *Attorney, Agent, or Firm* — Alston & Bird LLP

(57) ABSTRACT

A flexible packaging laminate for a microwavable package has a built-in vent for steam. The vent is formed by an outer score line through the outer layer(s) of the laminate to define an outer flap, and a smaller-footprint inner score line formed through the inner layer(s) of the laminate, so that there is a marginal region of U- or V-shape bounded between the two score lines. A patch of pressure-sensitive adhesive is disposed between the outer and inner structures of the laminate such that PSA is present in the marginal region. Pressure exerted on the inner flap or plug created by the inner score line overcomes the PSA between the outer flap and the inner structure in the marginal region, causing the outer flap to be pushed out along with the inner flap or plug, thereby venting steam through the resulting opening.

12 Claims, 9 Drawing Sheets

(51) Int. Cl.
*B65D 77/22* (2006.01)
*B31B 1/00* (2006.01)

(56) References Cited

U.S. PATENT DOCUMENTS

| | | | | |
|---|---|---|---|---|
| 6,170,985 | B1 | 1/2001 | Shabram et al. | |
| 6,582,123 | B1 | 6/2003 | Tang | |
| 7,051,762 | B2 | 5/2006 | Haamer | |
| 7,709,069 | B2 | 5/2010 | Schmal et al. | |
| 7,781,036 | B2 | 8/2010 | Gerbeling et al. | |
| 7,798,713 | B2 | 9/2010 | Blythe et al. | |
| 7,837,387 | B2 | 11/2010 | Newrones et al. | |
| 8,087,827 | B2 | 1/2012 | Mir | |
| 2001/0012530 | A1 | 8/2001 | Hiyoshi | |
| 2004/0191476 | A1 | 9/2004 | Wallen et al. | |
| 2005/0067411 | A1* | 3/2005 | Monforton et al. | 219/727 |
| 2005/0173425 | A1 | 8/2005 | Wnek et al. | |
| 2005/0218143 | A1 | 10/2005 | Niederer et al. | |
| 2005/0276885 | A1 | 12/2005 | Bennett | |
| 2006/0003146 | A1 | 1/2006 | Hanspeter | |
| 2007/0087096 | A1 | 4/2007 | Mir | |
| 2009/0045189 | A1 | 2/2009 | Cormier et al. | |
| 2009/0117323 | A1 | 5/2009 | Lin | |
| 2010/0065555 | A1 | 3/2010 | Lonergan et al. | |
| 2010/0068352 | A1* | 3/2010 | Lonergan et al. | 426/106 |
| 2011/0179754 | A1 | 7/2011 | Utz | |
| 2012/0061385 | A1* | 3/2012 | France et al. | 219/727 |
| 2012/0196060 | A1 | 8/2012 | Hansen et al. | |

FOREIGN PATENT DOCUMENTS

| | | | |
|---|---|---|---|
| EP | 1 422 164 | A1 | 5/2004 |
| EP | 1 577 226 | A1 | 9/2005 |
| EP | 2 078 683 | A1 | 7/2009 |
| JP | 2000 191054 | A | 7/2000 |
| WO | WO 2004/045970 | A1 | 6/2004 |
| WO | WO 2007/070786 | A1 | 6/2007 |
| WO | WO 2008/115693 | A1 | 9/2008 |

OTHER PUBLICATIONS

Office Action from corresponding European Patent Application No. 14158974.7 dated Aug. 14, 2015.

* cited by examiner

HERMETIC MICROWAVABLE PACKAGE WITH AUTOMATICALLY OPENING STEAM VENT

BACKGROUND OF THE INVENTION

This invention relates to flexible packaging for products, and particularly relates to microwavable packages made from such material.

A variety of microwavable food products are packaged in packages constructed at least in part from flexible packaging materials formed primarily of laminations of one or more of polymer films, and sometimes including paper in addition. Consumers desire quick and easy meals that can be cooked in the microwave oven without having to dirty up a lot of dishes in the process. Accordingly, packages that allow cooking in the package have been developed.

Microwavable packages require venting during cooking, or else the steam pressure built up in the package will cause the package to burst open uncontrollably. Venting is not as simple as it may seem. The package must keep enough steam inside to cook the food without drying it out, yet let enough steam out to keep the package from bursting. Venting holes have been used for this purpose, but they do not allow a hermetic package. Alternatively, some packages require the user to remove or lift a piece of the package material, or puncture the package. This method relies too much on the proper execution by the user.

Accordingly, improvements in microwavable packages are sought.

BRIEF SUMMARY OF THE INVENTION

The present invention addresses the above needs and achieves other advantages, by providing a flexible packaging structure for a microwavable package, in which the structure has a built-in vent feature. In accordance with one aspect of the invention, the packaging structure comprises a two-part structure, having an outer structure joined in face-to-face relation with an inner structure. Each of the outer and inner structures can comprise one or more layers of flexible packaging material such as polymer film. A continuous outer score line is formed through the thickness of the outer structure, but not breaching the inner structure. The outer score line has a generally U- or V-shaped configuration. This outer score line accordingly defines an outer flap that can be lifted out of the plane of the outer structure, by pivoting about a fixed end of the flap defined by two ends of the score line. Similarly, a continuous inner score line is formed through the thickness of the inner structure but not breaching the outer structure, to define an inner flap or plug that can be lifted out of the plane of the inner structure. The inner score line has a smaller foot print than and is wholly contained within the area bounded by the outer score line. As a consequence, there is a marginal region bounded by the inner and outer score lines.

A patch of pressure-sensitive adhesive (PSA) is disposed between the inner and outer structures, registered with the inner and outer score lines, so that the PSA is present between the two structures in the marginal region. The PSA allows the outer flap to be lifted away from the underlying inner structure, with the inner flap or plug remaining adhered to the outer flap via the same PSA. This causes an opening to be formed through the structure.

In accordance with one embodiment of the invention, the pressure-sensitive adhesive is pattern-applied onto one surface of one of the structures, the pressure-sensitive adhesive forming a patch, and a permanent laminating adhesive is pattern-applied onto the one surface of the structure such that the permanent adhesive does not cover the patch of pressure-sensitive adhesive. Next, that structure is adhesively joined to the other structure via the permanent adhesive so as to form a laminate. The outer structure and inner structure in preferred embodiments are coextensive with each other, and advantageously are each continuous webs drawn from respective supply rolls and laminated together to form a laminate that is a continuous web.

The laminate is then advanced to a scoring station at which an outer score line is formed through the thickness of the outer structure, and an inner score line is formed through the thickness of the inner structure. Advantageously, each of the score lines is registered with respect to the patch of pressure-sensitive adhesive such that neither score line is located where there is permanent laminating adhesive between the outer and inner structures.

It is also within the scope of the invention to use only pressure-sensitive adhesive, with no permanent laminating adhesive. In this case, the pressure-sensitive adhesive serves to join the outer structure to the inner structure over their entire surfaces.

The score lines can be formed by laser scoring or by mechanical scoring or cutting such as by die cutting. The adhesive(s) can be applied to the outer structure as noted, but alternatively can be applied to the inner structure. The adhesive(s) can be applied using any suitable equipment and technique, such as by a gravure roll or the like.

The outer score line or score line preferably penetrates through the thickness of the outer structure but not through the inner structure. Similarly, the inner score line preferably penetrates through the thickness of the inner structure but not through the outer structure.

The inner structure of the laminate can include a sealant layer forming the inner surface of the laminate. The sealant layer can comprise a heat seal material such as polyethylene, polypropylene, ionomer resin such as SURLYN®, or the like, or a cold seal material. The heat seal or cold seal layer can comprise either a film or a coating. The inner structure advantageously also includes a barrier layer providing a barrier against the passage of moisture and/or oxygen. The barrier layer can comprise any of various polymer-based barrier materials including barrier polymer films such as ethylene vinyl alcohol copolymer (EVOH), polyamide, and the like; AlOx-coated polymer films; SiOx-coated polymer films; and others.

The outer structure can include a layer of polyester such as polyethylene terephthalate, which has a desirable crisp feel and is readily printed. The polyester layer can be printed with inks to provide graphics and indicia. In preferred embodiments, the polyester layer is transparent and is reverse-printed on the surface that faces the inner structure.

The process in accordance with the invention comprises an in-line process wherein the vent features are formed in the packaging laminate during the production of the laminate.

To use a package formed by, or in part by, the flexible packaging structure as described above, the package is placed in the microwave oven, vent up. During heating, as pressure builds up within the package, eventually the pressure exerted on the inner flap or plug of the vent creates a force large enough to overcome the PSA between the outer flap and the underlying inner structure in the marginal region, causing the outer flap to be pushed out along with the inner flap or plug, thereby venting steam through the resulting opening.

The amount of pressure maintained during the cook cycle is related to various factors, including the area of the hole created by the vent and the internal volume of the package.

The amount of pressure required to open the vent is related to at least the area of the inner flap or plug (denoted "AI"), the area of the marginal region (denoted "AM"), and the amount and type of PSA used.

In some embodiments of the invention, the vent feature is characterized by the ratio of AI to AM being within prescribed limits. The vent feature can also be characterized by the coat weight of the PSA being within prescribed limits.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF EMBODIMENTS

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

As an initial overview of certain embodiments of the invention, a flexible packaging laminate is constructed to have a built-in steam vent. The laminate is constructed as a multilayer structure by adhesively laminating a first structure to a second structure, wherein each of the first and second structures comprises one or more layers of flexible material(s). Permanent and pressure-sensitive adhesives are applied to one or both of the structures in predetermined patterns. Once the laminate is formed in this manner, scoring operations are performed on both sides of the laminate in registration with the adhesive patterns, but each scoring operation penetrates only through a part of the thickness of the laminate; in particular, a scoring operation performed on the side of the laminate adjacent the first structure results in penetration through the first structure, but without complete penetration through the second structure, and preferably without any substantial penetration, and more preferably without any penetration, into the second structure. Likewise, the scoring operation performed on the side of the laminate adjacent the second structure results in penetration through the second structure, but without complete penetration through the first structure, and preferably without any substantial penetration, and more preferably without any penetration, into the first structure.

Figure 1:
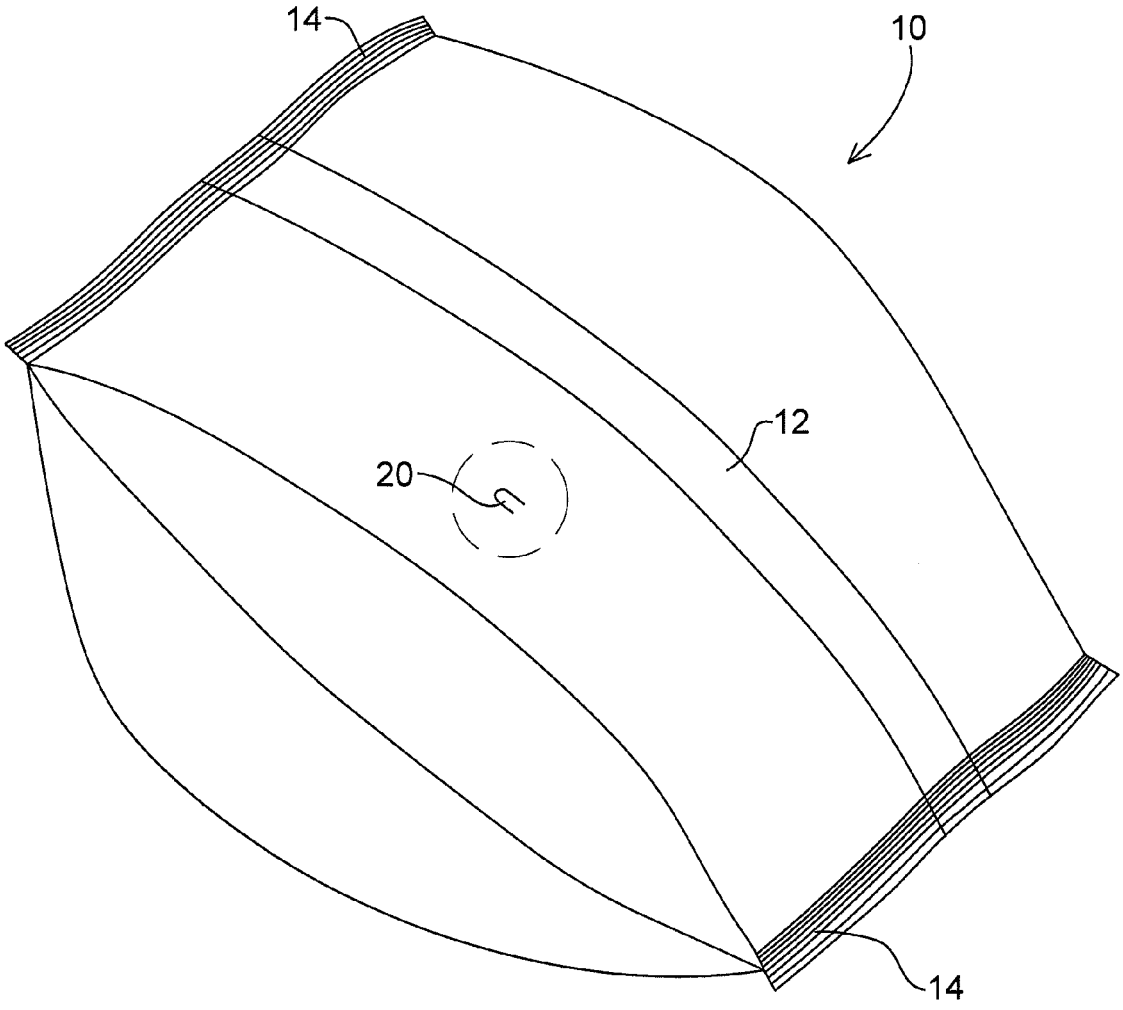
FIG. 1 is a perspective view of a microwavable package in accordance with one embodiment of the invention.

FIG. 1 shows a microwavable package 10 in accordance with one embodiment of the invention. The package 10 is a bag formed from the flexible packaging structure, and includes a longitudinal fin seal 12 and two end seals 14. Formed in the wall of the package in a suitably selected location is a steam vent 20, which is described in greater detail below. The steam vent preferably is located with respect to the configuration and intended orientation of the package during microwave cooking so that the vent is not obstructed by anything that could hinder its proper opening. Thus, as shown, it can be located on an upper side of the package in the cooking orientation.

Figure 2:
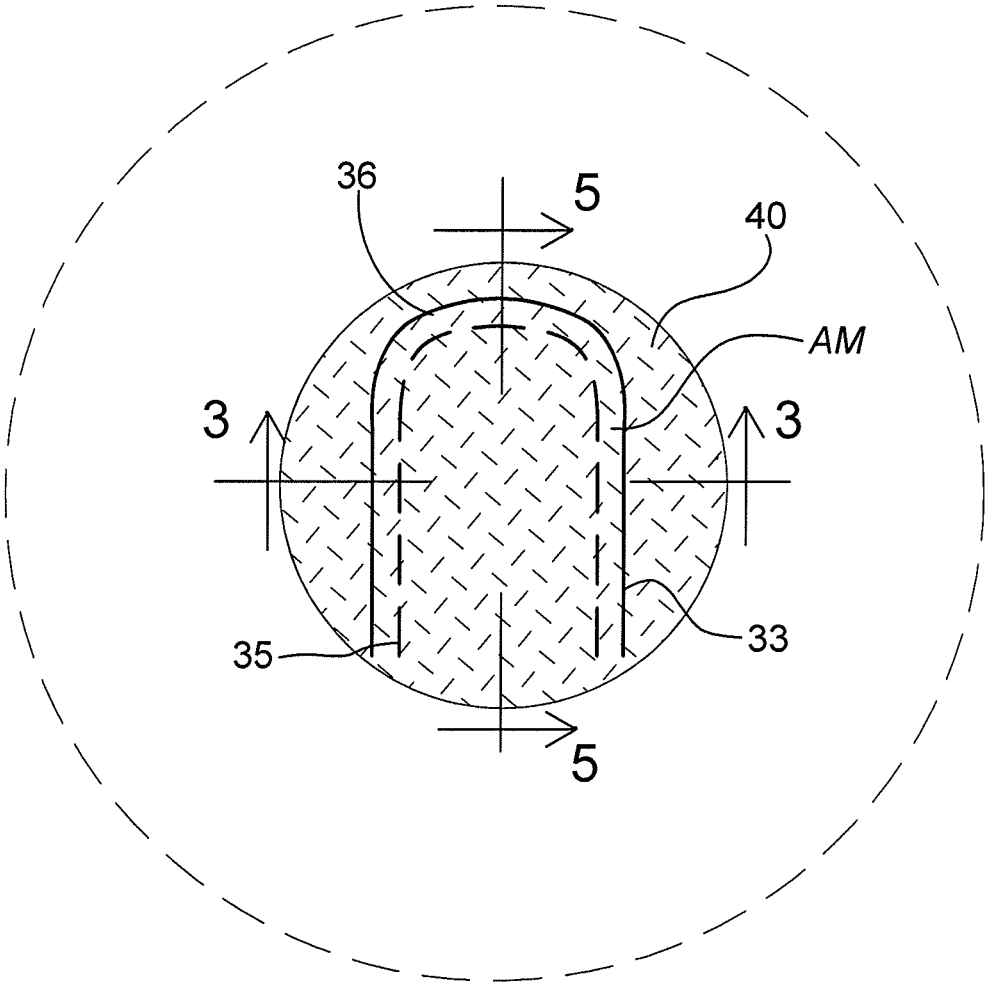
FIG. 2 is top view of a steam vent on the package of FIG. 1, magnified to show details.
Figure 2A:
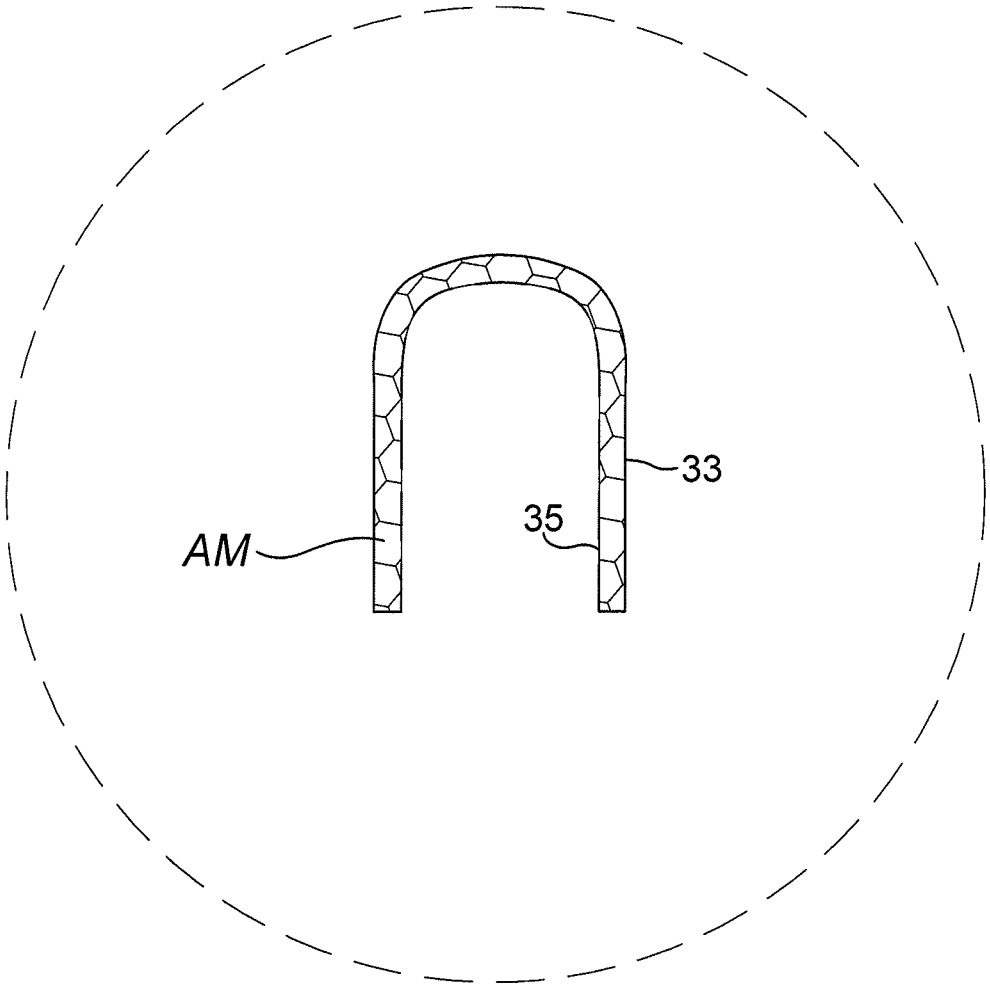
FIG. 2A shows the steam vent of FIG. 2 with the marginal area AM highlighted.
Figure 3:
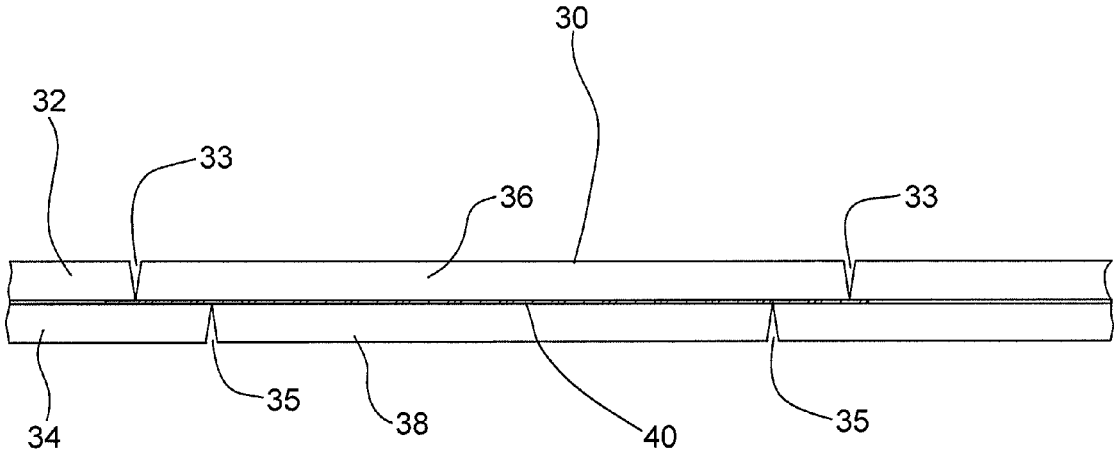
FIG. 3 is a cross-sectional view of the steam vent along line 3-3 of FIG. 2.

As noted, the steam vent 20 is a built-in or integral feature of the laminate making up the package. FIGS. 2 and 3 illustrate in greater detail how the vent is constructed. With initial reference particularly to FIG. 3, it can be seen that the wall 30 of the package comprises a laminate having an outer structure 32 and an inner structure 34 that are adhesively laminated together to form the laminate. Each of the inner and outer structures can be made up of one or more than one distinct layer of material. The invention is not limited to any particular makeup or composition of the structures. With reference now to both FIG. 2 and FIG. 3, a continuous (i.e., non-interrupted along its full length) score line 33 is formed in the outer structure 32 in an open-loop configuration. In this particular embodiment, the outer score line 33 is generally U-shaped. A continuous score line 35 is also formed in the inner structure 34. The inner score line 35 occupies a smaller footprint than, and is wholly contained within the bounds of, the outer score line. Accordingly, there is a marginal area AM bounded between the outer and inner score lines.

The outer score 33 is line formed through the thickness of the outer structure 32 but does not breach the inner structure 34. The outer score line defines an outer flap 36 that can be lifted out of the plane of the outer structure, by pivoting about a fixed end of the outer flap defined by two ends of the outer score line. The inner score line 35 similarly is formed through the thickness of the inner structure but does not breach the outer structure, so as to define an inner flap or plug 38 that can be lifted out of the plane of the inner structure.

Figure 5:
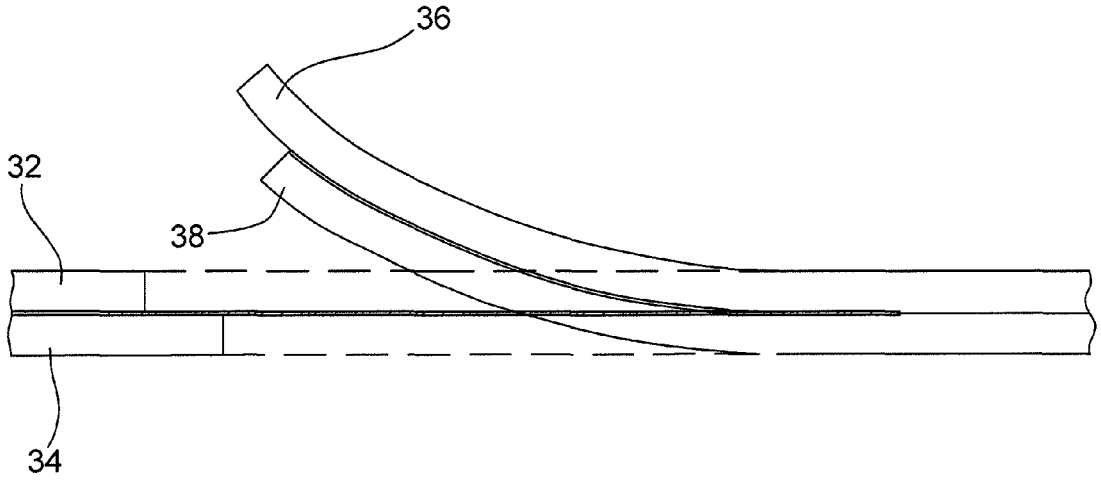
FIG. 5 is a cross-sectional view along line 5-5 in FIG. 2, showing the steam vent in its original closed position (dashed lines) and in an open position (solid lines)

As noted, in some embodiments the two structures 32 and 34 are adhesively laminated together by both permanent adhesive and pressure-sensitive adhesive (PSA) disposed between the structures. The PSA comprises a localized patch 40 of PSA registered with the inner and outer score lines, so that the PSA is present between the two structures in the marginal region, as best seen in FIG. 2. The PSA allows the outer flap 36 to be lifted away from the underlying inner structure 34, with the inner flap or plug 38 remaining adhered to the outer flap via the PSA, thereby causing an opening to be formed through the structure, as depicted in FIG. 5. In regions where there is no PSA, the structures are joined by permanent adhesive.

In an alternative embodiment, the PSA can be the sole adhesive for the laminate, and can be present substantially everywhere between the structures, except perhaps for localized region(s) where it may be desired to have no adhesive.

The pressure-sensitive adhesive can comprise various compositions. Pressure-sensitive adhesives form viscoelastic bonds that are aggressively and permanently tacky, adhere without the need of more than a finger or hand pressure, and require no activation by water, solvent or heat. Pressure-sensitive adhesives are often based on non-crosslinked rubber adhesives in a latex emulsion or solvent-borne form, or can comprise acrylic and methacrylate adhesives, styrene copolymers (SIS/SBS), and silicones. Acrylic adhesives are known for excellent environmental resistance and fast-setting time when compared with other resin systems. Acrylic pressure-sensitive adhesives often use an acrylate system. Natural rubber, synthetic rubber or elastomer sealants and adhesives can be based on a variety of systems such as silicone, polyurethane, chloroprene, butyl, polybutadiene, isoprene, or neoprene. When the packaging laminate of the invention is to be used for food packaging, the pressure-sensitive adhesive generally must be a food-grade composition. Various pressure-sensitive adhesives are approved by the U.S. Food and Drug Administration for use in direct food contact, as regulated by 21 CFR Part 175.300. A preferred food-grade pressure-sensitive adhesive for use in the present invention is 23309B available from Ashland. Additives (e.g., particulates or the like) can be added to the pressure-sensitive adhesive to reduce the tenacity of the bond to the underlying second structure 42, if necessary, so that the pressure-sensitive adhesive readily detaches from the second structure on opening (particularly on the very first opening).

The pattern 40 of pressure-sensitive adhesive would be applied to one of the two structures at regular intervals along the structure. The spacing or index distance between the patterns can correspond to a dimension, such as a length, of packages to be produced from the packaging laminate. The adhesive application can be performed by any suitable device capable of accurately applying the pressure-sensitive adhesive to the structure in the desired pattern 40, at regular intervals along the structure. For example, the adhesive application station can comprise a gravure roll that picks up the pressure-sensitive adhesive from a reservoir on the outer surface of the roll such that the adhesive fills one or more recessed areas in the surface. A doctor blade scrapes off excess adhesive so that it remains essentially only in the recessed area(s). The structure is contacted by the gravure roll; a backing roll provides support on the opposite side of the structure.

After application of the pressure-sensitive adhesive, the structure can be advanced to a dryer such as an oven or the like, to dry the pressure-sensitive adhesive. The structure is then advanced to a second adhesive application station at which a permanent laminating adhesive is applied to the structure in such a manner that a sufficiently large proportion of the surface is covered by the permanent adhesive to permit the structure to be adhesively attached to the other structure at a downstream laminating station. The permanent adhesive does not cover the pressure-sensitive adhesive 40. The permanent adhesive can be applied by an apparatus capable of accurately applying the adhesive in a predetermined pattern, in registration with the pressure-sensitive adhesive but not covering it. A suitable adhesive application device can be a gravure roll of the type previously described. The permanent adhesive can comprise various compositions. Suitable examples include two-component polyurethane adhesive systems, such as Tycel 7900/7283 available from Henkel.

After the application of the permanent adhesive, the structure is advanced to a dryer such as an oven or the like. The structure is then advanced to a laminating station, comprising a pair of rolls forming a nip therebetween. The structure is passed through the nip along with the other structure that is advanced from its own supply roll, and the two structures are laminated to each other. The two structures preferably are coextensive—i.e., the width of each structure is substantially equal to the width of the other structure and the longitudinal edges of the two structures substantially coincide. The resulting laminate is then advanced to a reel-up where it is wound into a roll for subsequent processing in the second phase of the manufacturing process as described below. Alternatively, it is possible for the reel-up operation to be omitted, such that the laminate is directly advanced to the second phase.

The laminate can then be advanced to a first scoring station at which the outer score line 33 is formed through the thickness of the outer structure 32. The outer score line is in registration with the patch-shaped pattern 40 of pressure-sensitive adhesive. The outer score line extends substantially through the thickness of the outer structure, but preferably does not extend to any substantial extent into the second structure 34, as illustrated in FIG. 3. Next, the laminate is advanced to a second scoring station at which the inner score line 34 is formed through the thickness of the inner structure 34. The inner score line extends through the thickness of the inner structure, but preferably does not extend to any substantial extent into the outer structure, as illustrated in FIG. 3.

The score lines can be formed in the laminate by mechanical scoring or cutting, or by laser, or by a combination thereof.

After the scoring operations, the laminate can be sent to a reel-up (not shown) and wound into a roll for subsequent processing. The laminate can also be slit into a plurality of partial widths and wound into multiple rolls. In this latter instance, each partial width would have the recurring patterns of pressure-sensitive and permanent adhesives applied with suitably configured adhesive applicators to the full-width material, and would have the recurring score lines formed by suitably configured scoring devices acting on either the full-width laminate prior to slitting or acting on each partial-width portion after slitting.

An advantage of the invention, versus the formation of a web having discrete labels applied to the web surface as in prior art valve structures, is that the laminate has a uniform thickness throughout (because the first and second structures are coextensive) and therefore winds well into good-quality rolls. In contrast, a web with labels centrally located in the width of the web tends to produce wound rolls that are soft in the radial direction at the two ends of the roll where the labels are not present. Additionally, the web with labels is much thicker than laminates made in accordance with the invention, and hence the laminates of the invention can achieve a greater square footage per roll of a given diameter. As already noted, a further drawback to the use of labels is the necessity of applying the labels to the web in an "off-line" process, which often entails shipping a roll of the web to a converter that applies the labels and then ships the roll back to the package manufacturer. In the process of the invention, the manufacture of the laminate and the incorporation of the opening and reclose features in the laminate are conducted in an in-line fashion as part of the same overall process. The process of the invention thus is much more efficient and less costly.

Additionally, the invention avoids other drawbacks associated with the use of labels. More specifically, pressure-sensitive adhesive labels typically require a release liner that is peeled off and thrown away, which represents waste. Furthermore, there is the additional waste of the skeleton material left over after die-cutting the labels from the label web material. The present invention eliminates such waste and attendant costs.

Figure 2B:
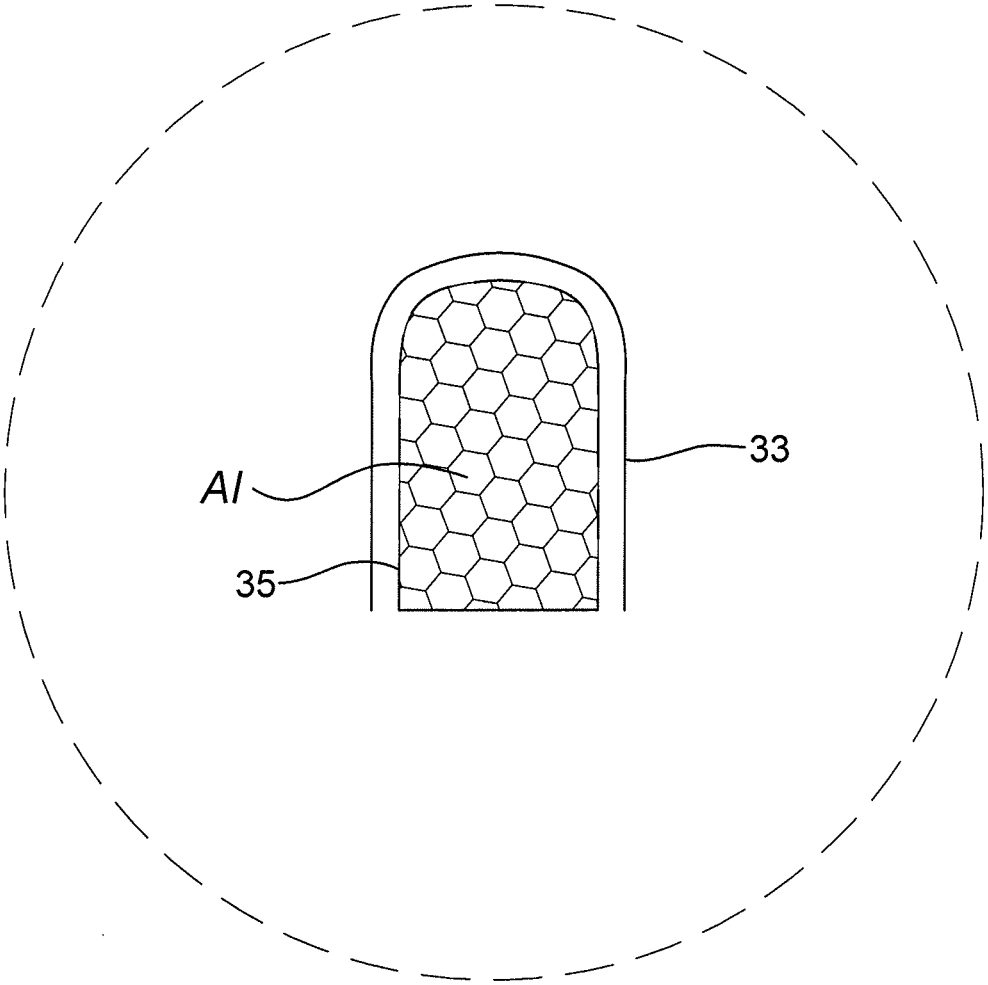
FIG. 2B shows the steam vent of FIG. 2 with the inside area AI highlighted.

Test specimens were constructed generally as described herein, having steam vents of different configurations. In particular, the vents were different with respect to the ratio of the inside area AI (FIG. 2B) to the marginal area AM (FIG.

Figure 4A:
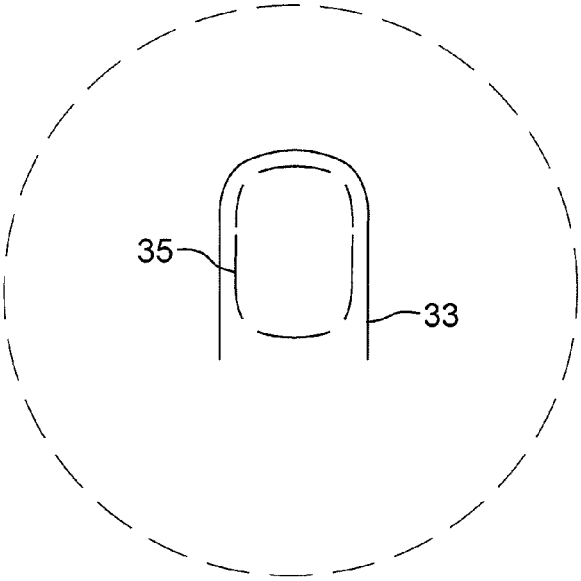
FIG. 4A is similar to FIG. 2 but illustrates an alternative configuration of steam vent in accordance with the invention.
Figure 4B:
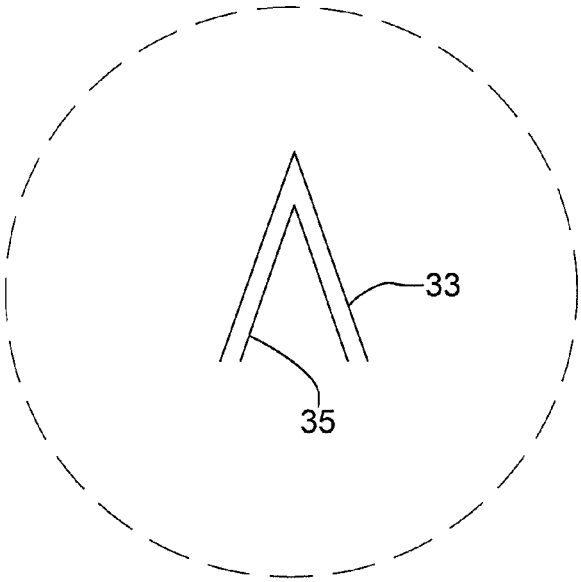
FIG. 4B shows yet another configuration of steam vent in accordance with the invention.
Figure 6:
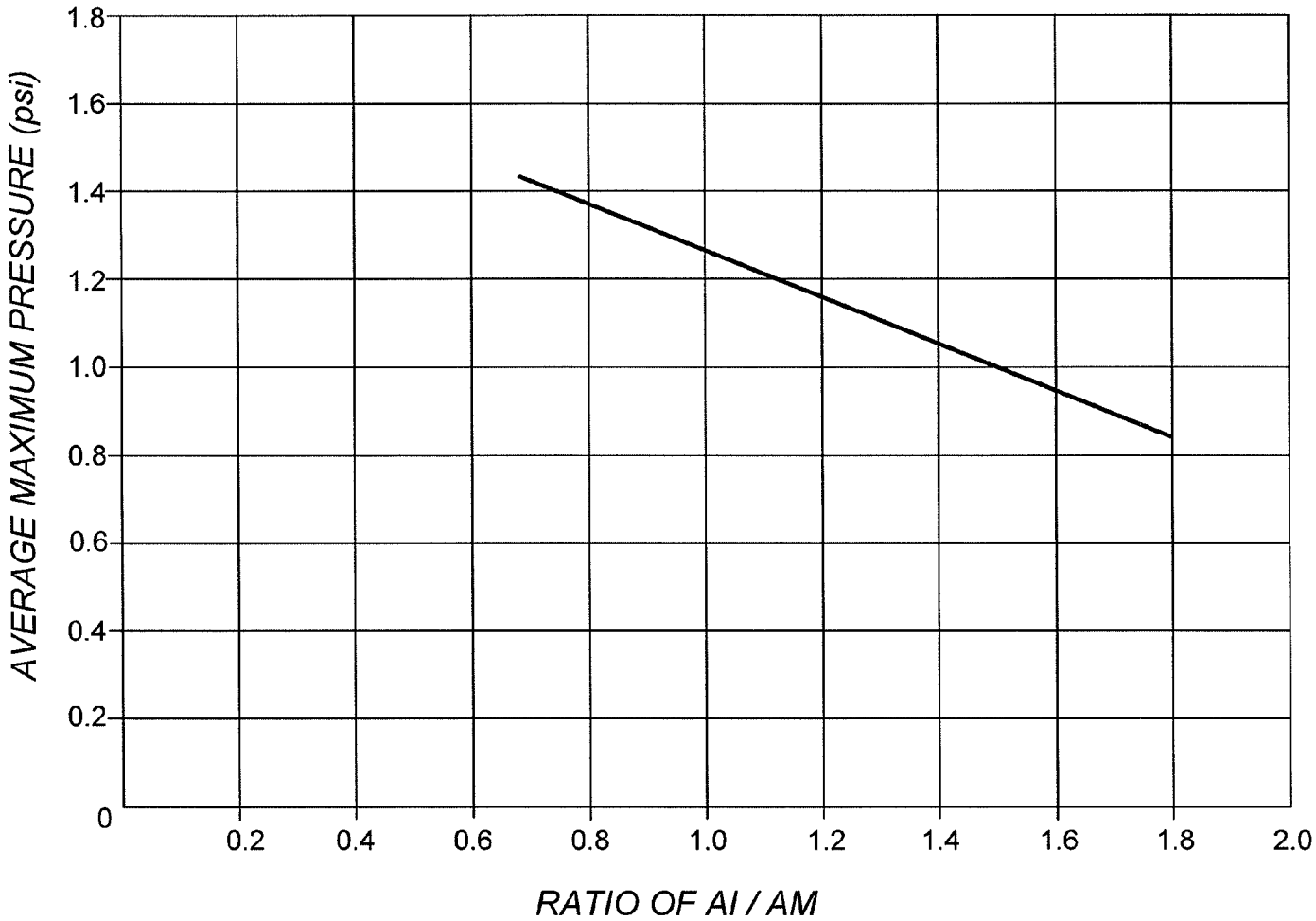
FIG. 6 is a plot of test data representing average maximum pressure exerted on the steam vent as a function of the ratio of inside area to marginal area.
Figure 7:
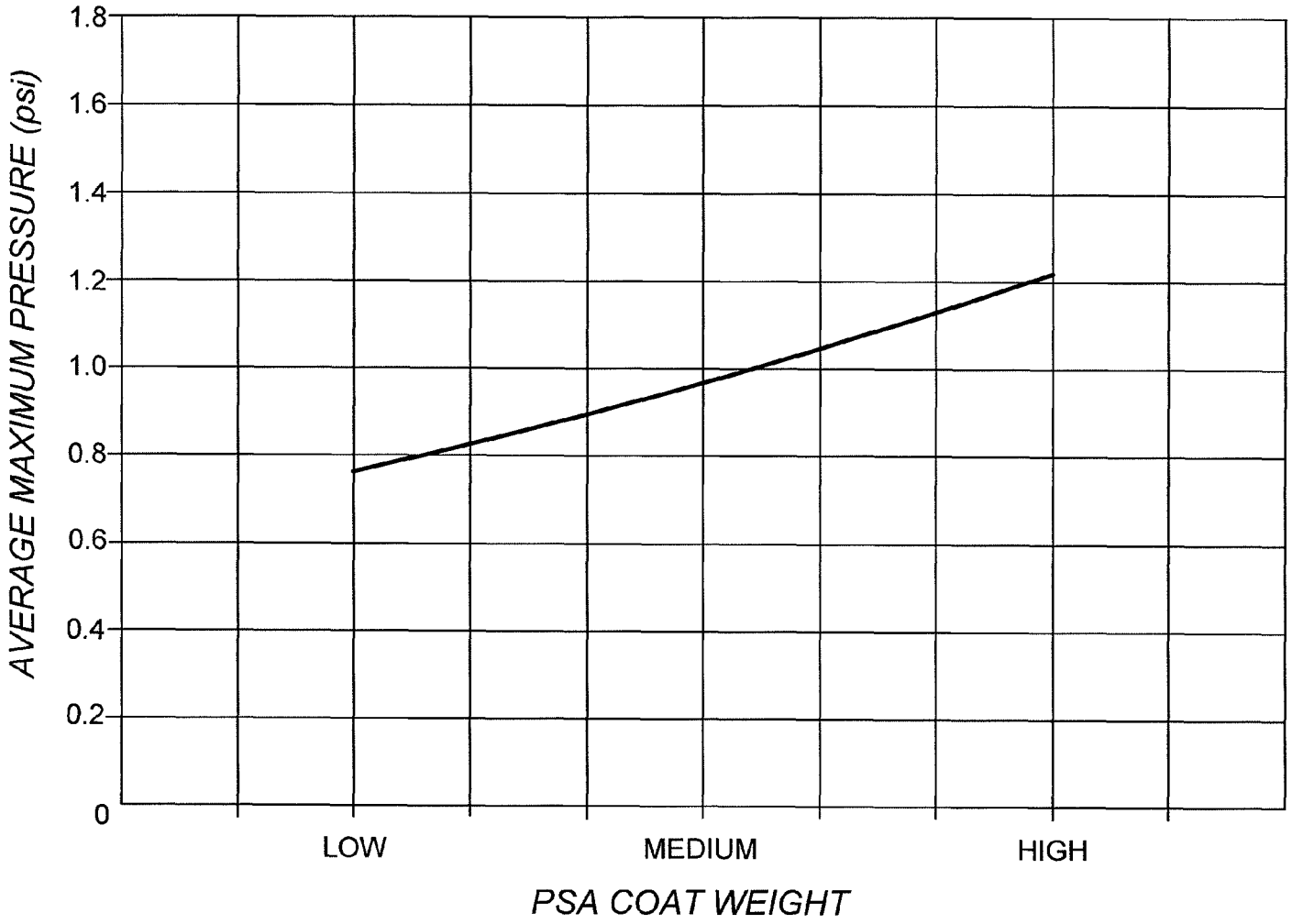
FIG. 7 is a plot of test data representing average maximum pressure exerted on the steam vent as a function of coat weight of the pressure-sensitive adhesive.

2A) of the vent. The vents included both U-shaped vents (FIG. 2) and V-shaped vents (FIG. 4B). Additionally, various coat weights of the PSA were tested for one of the vent configurations. The tests consisted of subjecting the vent to a gradually increasing air pressure and measuring the pressure as a function of time. The pressure built up until the vent opened, at which point it abruptly dropped. The maximum pressure achieved was recorded for each test specimen. FIGS. 6 and 7 show the test results.

FIG. 6 shows the average maximum pressure as a function of the ratio of AI/AM. FIG. 7 shows the average maximum pressure as a function of PSA coat weight. These tests demonstrate the ability of the invention to tailor the vent performance to a given requirement. More particularly, the opening pressure can be selected by suitably selecting the vent configuration (specifically, the noted area ratio). Additionally or alternatively, the opening pressure can be selected by suitably selecting the coat weight of the PSA As one example, the area ratio can be chosen to be relatively low and the coat weight can be chosen to be relatively high so as to achieve a relatively high average maximum pressure within a microwavable package constructed with the laminate.

As another example, area ratio can be chosen to be relatively high and the coat weight can be chosen to be relatively low so as to achieve a relatively low average maximum pressure within a microwavable package constructed with the laminate.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A flexible packaging structure for a microwavable package, in which the structure has a built-in vent feature, the packaging structure comprising:

an outer structure joined in face-to-face relation with an inner structure, each of the outer and inner structures comprising one or more layers of flexible packaging material;

a continuous outer score line formed through the thickness of the outer structure, but not breaching the inner structure, the outer score line having a generally U- or V-shaped configuration so as to define an outer flap that can be lifted out of the plane of the outer structure, by pivoting about a fixed end of the outer flap defined by two ends of the outer score line;

a continuous inner score line formed through the thickness of the inner structure but not breaching the outer structure, to define an inner flap or plug that can be lifted out of the plane of the inner structure, the inner score line having a smaller foot print than and being wholly contained within the area bounded by the outer score line, such that there is a marginal region bounded by the inner and outer score lines;

a localized patch of pressure-sensitive adhesive (PSA) disposed between the inner and outer structures, registered with the inner and outer score lines, so that the PSA is present between the two structures in the marginal region, the PSA allowing the outer flap to be lifted away from the underlying inner structure, with the inner flap or plug remaining adhered to the outer flap via the PSA, thereby causing an opening to be formed through the structure.

2. The flexible packaging structure of claim 1, wherein the outer structure is coextensive with the inner structure.

3. The flexible packaging structure of claim 1, wherein the marginal region is generally U-shaped.

4. The flexible packaging structure of claim 1, wherein the marginal region is generally V-shaped.

5. The flexible packaging structure of claim 1, wherein the inner flap or plug has an inner area AI and the marginal region has a marginal area AM, and the PSA has a coat weight, and the ratio of AI to AM is chosen based at least in part on the coat weight of the PSA.

6. A method for making a flexible packaging laminate having a built-in steam vent, comprising the steps of:

pattern-applying a pressure-sensitive adhesive onto one surface of a first structure comprising at least one layer of flexible material, the pressure-sensitive adhesive forming a localized patch;

pattern-applying a permanent laminating adhesive onto the one surface of the first structure such that the permanent adhesive does not cover the patch of pressure-sensitive adhesive (PSA);

adhesively joining the first structure to a second structure via the adhesives so as to form a laminate, the second structure comprising at least one layer of flexible material, wherein one of the first and second structures comprises an outer structure and the other comprises an inner structure; and advancing the laminate to a scoring station at which an outer score line is formed through the thickness of the outer structure in registration with the patch of pressure-sensitive adhesive, and an inner score line is formed through the thickness of the inner structure in registration with the patch, the outer score line having a generally U- or V-shaped configuration so as to define an outer flap that can be lifted out of the plane of the outer structure, by pivoting about a fixed end of the outer flap defined by two ends of the outer score line, the inner score line defining an inner flap or plug that can be lifted out of the plane of the inner structure, the inner score line having a smaller foot print than and being wholly contained within the area bounded by the outer score line, such that there is a marginal region bounded by the inner and outer score lines.

7. The method of claim 6, wherein the outer structure is coextensive with the inner structure.

8. The method of claim 6, wherein the marginal region is generally U-shaped.

9. The method of claim 6, wherein the marginal region is generally V-shaped.

10. The method of claim 6, wherein the inner flap or plug has an inner area AI and the marginal region has a marginal area AM, and the PSA has a coat weight, and a ratio R of AI to AM is chosen based at least in part on the coat weight of the PSA.

11. The method of claim 10, wherein the ratio R is chosen to be relatively low and the coat weight is chosen to be relatively high so as to achieve a relatively high average maximum pressure within a microwavable package constructed with the laminate.

12. The method of claim 10, wherein the ratio R is chosen to be relatively high and the coat weight is chosen to be relatively low so as to achieve a relatively low average maximum pressure within a microwavable package constructed with the laminate.

* * * * *